US012419425B2

(12) United States Patent
Nakaura

(10) Patent No.: US 12,419,425 B2
(45) Date of Patent: Sep. 23, 2025

(54) FRAME STRUCTURE

(71) Applicant: HONDA MOTOR CO., LTD., Tokyo (JP)

(72) Inventor: So Nakaura, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 222 days.

(21) Appl. No.: 18/466,902

(22) Filed: Sep. 14, 2023

(65) Prior Publication Data

US 2024/0108143 A1 Apr. 4, 2024

(30) Foreign Application Priority Data

Sep. 29, 2022 (JP) ..... 2022-155752

(51) Int. Cl.
*A47C 7/66* (2006.01)
*A47C 7/72* (2006.01)
(Continued)

(52) U.S. Cl.
CPC ..... *A47C 7/666* (2018.08); *A47C 15/004* (2013.01); *A47C 27/081* (2013.01); *A47C 29/003* (2013.01); *E04H 15/02* (2013.01); *E04H 15/56* (2013.01); *A47C 17/64* (2013.01); *E04H 2015/208* (2013.01); *E04H 15/324* (2013.01)

(58) Field of Classification Search
CPC ..... A47C 7/666; A47C 15/004; A47C 27/081; A47C 29/003; A47C 17/64; A47C 4/54; A47C 7/021; A47C 7/72; E04H 15/02; E04H 15/56; E04H 15/324; E04H 2015/208
See application file for complete search history.

(56) References Cited

U.S. PATENT DOCUMENTS 947,472 A * 1/1910 Lehmann ..... A47C 17/64 135/96
2,188,213 A * 1/1940 Wilson ..... E04H 1/1244 135/904
(Continued)

FOREIGN PATENT DOCUMENTS

JP 2003-328598 A 11/2003
JP 2009-300034 A 12/2009
KR 10-2013-0091700 A 8/2013

OTHER PUBLICATIONS

Japanese Office Action dated Jun. 25, 2024 issued in corresponding Japanese application No. 2022-155752; English translation included (8 pages).

*Primary Examiner* — Robert Canfield
(74) *Attorney, Agent, or Firm* — Rankin, Hill & Clark LLP

(57) ABSTRACT

A frame structure defines a space capable of accommodating a user, and includes a plurality of outline frames that forms an assembly-type framework for the space, a sheet that is stretched over the framework so as to form a floor surface, a side surface, and a top surface of the space, a support frame that supports the floor surface at a position higher than a base surface where the frame structure is placed, a battery attachment portion that enables attachment of a battery to an under surface side of the floor surface, an outlet provided on any of the floor surface, the side surface, and the top surface, and a battery connecting portion that connects the battery attached to the battery attachment portion and the outlet.

4 Claims, 3 Drawing Sheets

(51) Int. Cl.

| | |
|---|---|
| ***A47C 15/00*** | (2006.01) |
| ***A47C 27/08*** | (2006.01) |
| ***A47C 29/00*** | (2006.01) |
| ***E04H 15/02*** | (2006.01) |
| ***E04H 15/56*** | (2006.01) |
| *A47C 17/64* | (2006.01) |
| *E04H 15/20* | (2006.01) |
| *E04H 15/32* | (2006.01) |

(56) References Cited

U.S. PATENT DOCUMENTS

| | | | | |
|---|---|---|---|---|
| 5,210,888 | A * | 5/1993 | Canfield | A47C 29/003 5/113 |
| 6,354,044 | B1 * | 3/2002 | Lagace, Jr. | A47C 15/004 52/79.5 |
| 6,397,869 | B1 * | 6/2002 | Jennings | E04H 15/32 135/93 |
| 7,698,756 | B1 * | 4/2010 | Chen | A47C 17/72 135/96 |
| 7,753,063 | B1 | 7/2010 | Laws | |
| 9,185,988 | B1 * | 11/2015 | Sanchez | A47C 7/72 |
| 9,259,094 | B1 * | 2/2016 | McCauley | A01K 1/033 |
| 9,901,177 | B1 * | 2/2018 | Ulrich | A47C 27/082 |
| 10,584,511 | B1 * | 3/2020 | Slaughter | E04B 1/345 |
| 10,801,231 | B1 * | 10/2020 | Ensign | E04H 15/12 |
| D1,054,222 | S * | 12/2024 | Nakaura | D21/838 |
| 2003/0024560 | A1 * | 2/2003 | Tomason | E04H 15/02 135/117 |
| 2003/0107248 | A1 * | 6/2003 | Sanford | B64D 11/06 297/217.3 |
| 2007/0209694 | A1 | 9/2007 | Gooch et al. | |
| 2008/0072945 | A1 * | 3/2008 | Grand Pre | E04H 15/10 135/96 |
| 2008/0190471 | A1 * | 8/2008 | Tarter | E04H 15/14 135/96 |
| 2009/0039685 | A1 * | 2/2009 | Zernov | A47C 4/286 297/16.2 |
| 2010/0032998 | A1 * | 2/2010 | Eckman | A47C 7/748 297/217.3 |
| 2017/0143126 | A1 | 5/2017 | Wynn | |
| 2018/0014529 | A1 * | 1/2018 | Litwin | A01M 31/025 |
| 2018/0320403 | A1 * | 11/2018 | Choi | E04H 15/64 |
| 2019/0274298 | A1 * | 9/2019 | Peel | E04H 15/56 |
| 2019/0328141 | A1 * | 10/2019 | Cheng | A47C 7/72 |
| 2020/0221876 | A1 * | 7/2020 | Morales | A47C 7/66 |
| 2020/0243917 | A1 * | 7/2020 | Contreras | H01M 10/425 |
| 2020/0318376 | A1 * | 10/2020 | Ruggiero | A61M 21/02 |
| 2020/0329877 | A1 * | 10/2020 | Feldmann | A47C 29/003 |
| 2021/0007498 | A1 * | 1/2021 | Dorsainvil | H02J 7/35 |
| 2021/0321765 | A1 * | 10/2021 | Kwon | A47C 7/725 |
| 2023/0414004 | A1 * | 12/2023 | Yang | E04H 15/324 |
| 2024/0172874 | A1 * | 5/2024 | Long | A47C 7/72 |
| 2024/0298803 | A1 * | 9/2024 | Dressel | A47C 7/666 |
| 2024/0301902 | A1 * | 9/2024 | Hayashi | F16B 21/065 |

* cited by examiner

FRAME STRUCTURE

INCORPORATION BY REFERENCE

The present application claims priority under 35 U.S.C. § 119 to Japanese Patent Application No. 2022-155752 filed on Sep. 29, 2022. The content of the application is incorporated herein by reference in its entirety.

BACKGROUND OF THE INVENTION

Field of the Invention

The present invention relates to a frame structure.

Description of the Related Art

Conventionally, a tent unit with a floor has been known that can be set up regardless of topographic conditions of the set-up site by including a plurality of jacks to support a floor skeleton assembly at a predetermined height from the ground of the set-up site (see, for example, Japanese Patent Laid-Open No. 2003-328598).

In recent years, as the use purpose of tents, the purpose for use as a freely movable personal space has been increasing other than lodging. Further, when a tent is used as a personal space as such, there is a desire for spending comfortable time using various home electric appliances inside the tent. However, when the conventional tent is used, there is inconvenience in that a portable power supply or a power generator needs to be carried separately from the tent, and thus, easy carrying is difficult. Further, there is inconvenience in that preparation of connecting the portable power supply or the power generator brought in or placed near the tent and the home electric appliances inside the tent is burdensome.

An object of the present application, which has been made in view of such a background, is to provide a frame structure that defines a personal space where a home electric appliance is easily used and that is easy to carry.

SUMMARY OF THE INVENTION

As an aspect to achieve the aforementioned object, there is a frame structure defining a space capable of accommodating a user that includes a plurality of outline frames that forms an assembly-type framework for the space, a sheet that is stretched over the framework so as to form a floor surface, a side surface, and a top surface of the space, a support frame that supports the floor surface at a position higher than a base surface where the frame structure is placed, a battery attachment portion that enables attachment of a battery to an under surface side of the floor surface, an outlet provided on any of the floor surface, the side surface, and the top surface, and a battery connecting portion that connects the battery attached to the battery attachment portion and the outlet.

In the aforementioned frame structure, the configuration may be made so as to include an air cushion that is provided on an upper surface of the floor surface and inflated by air injection, the air cushion having an outer periphery when inflated larger than an outer periphery of a framework of the floor surface.

In the aforementioned frame structure, the battery attachment portion may be configured so as to be attached to the outline frame.

In the aforementioned frame structure, the configuration may be made so as to include an external battery connecting portion for connecting the battery connecting portion and an external battery other than the battery.

According to the aforementioned frame structure, it is possible to provide a frame structure that defines a personal space where a home electric appliance is easily used and that is easy to carry.

DETAILED DESCRIPTION OF THE PREFERRED EMBODIMENTS

1. Configuration of Frame Structure

Figure 1:
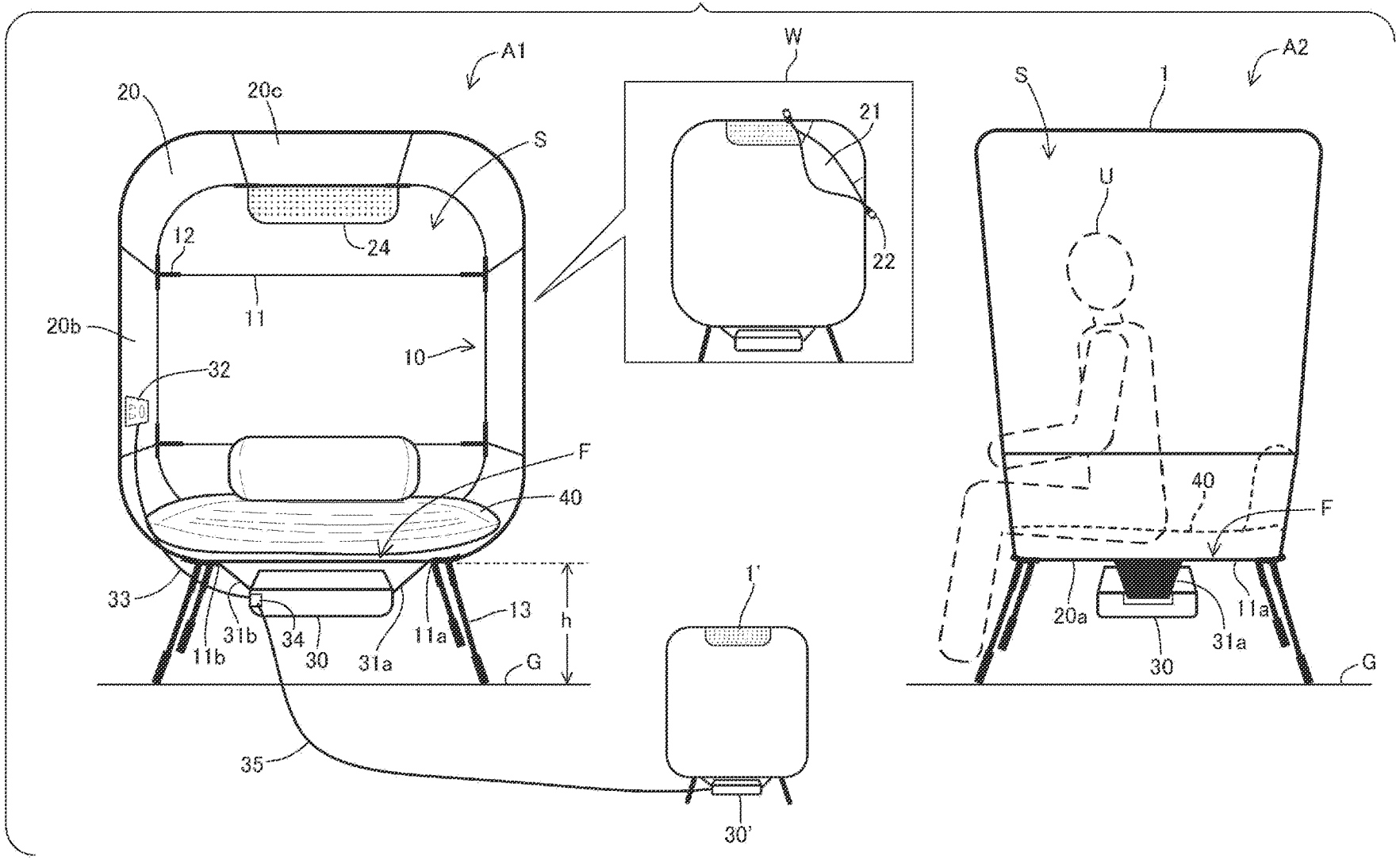
FIG. 1 is a configurational view of a frame structure.

With reference to FIG. 1, the configuration of a frame structure 1 of the present embodiment will be described. A1 of FIG. 1 is a front view of the frame structure 1 and A2 is a right side view of the frame structure 1.

The frame structure 1 includes a framework 10 that is formed by connecting a plurality of outline frames 11 by means of a joint 12 and that defines a space S capable of accommodating a user U, a sheet 20 (a floor surface sheet 20*a*, a side surface sheet 20*b*, and a top surface sheet 20*c*) that is stretched over the framework 10 so as to form a floor surface, a side surface, and a top surface of the space S, and a support frame 13 that supports a floor surface F formed by the floor surface sheet 20*a* at a position higher, by only h, than a base surface G (outdoor ground, indoor floor surface, or the like) where the frame structure 1 is placed. Note that the floor surface sheet 20*a*, the side surface sheet 20*b*, and the top surface sheet 20*c* may be one continuous sheet.

Further, the frame structure 1 includes battery attachment portions 31*a*, 31*b* for attaching a battery 30 to an under surface side of the floor surface F, an outlet 32 provided on the side surface sheet 20*b*, a battery cable 33 (corresponding to the battery connecting portion of the present disclosure) for connecting the battery 30 and the outlet 32, and an air cushion 40 placed on the floor surface F. The battery attachment portions 31*a*, 31*b* securely attach the battery 30 to outline frames 11*a*, 11*b* of the floor surface F. In this manner, as compared to a case in which the battery 30 is attached to the floor surface sheet 20*a*, the battery 30 can be stably attached.

The outlet 32 is provided with a socket for supplying an AC power with the same specification as that of a commercial power supply and a USB (Universal Serial Bus; Registered Trademark) port. The battery 30 includes a battery and an inverter that converts a DC power output from the battery into the AC power with the same specification as that of the commercial power supply and supplies, to the outlet 32, the DC power for the USB port and the AC power for the socket.

The air cushion 40 is inflated by air injection, and its outer periphery when the air cushion is inflated becomes larger than an outer periphery of the floor surface F. In this manner, when the user U sits on the air cushion 40, the weight load of the user U is dispersed to the outer side of the floor surface F by the air cushion, so that the battery 30 can be prevented from contacting the base surface G due to lowering of the floor surface F.

The battery 30 is provided with an external battery connecting portion 34 for connecting an output terminal of the battery 30 to an external battery. In FIG. 1, as the external battery, a battery 30' attached to another frame structure 1' is illustrated.

In this case, when a residual amount of the battery 30' is reduced, a user of the other frame structure 1' connects the battery 30' to the external battery connecting portion 34 of the battery 30 by means of an external connection cable 35, so that the power supplied from the battery 30 can be used. Therefore, the user of the other frame structure 1' can continue using a home electric appliance in the other frame structure 1' without replacing the battery 30' with a small residual amount.

As illustrated in a balloon W, a front surface sheet 21 can be attached to a front side of the frame structure 1 by means of a fastener 22. Further, an upper portion of the side surface sheet 20*b* is provided with a ventilation portion 24 made of a mesh fabric or the like.

2. Aspect of Attaching Floor Surface Sheet to Outline Frame

Figure 2:
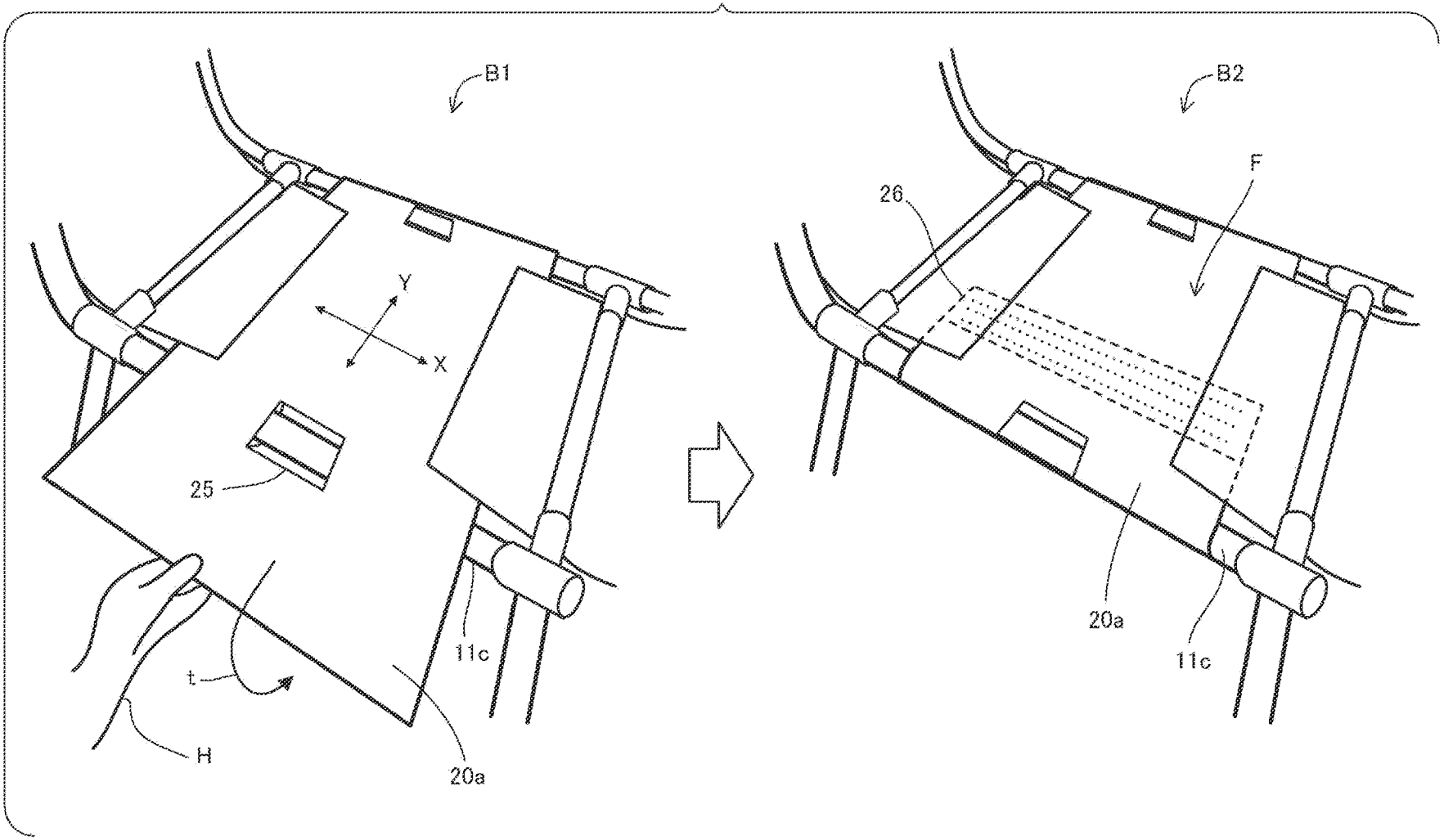
FIG. 2 is an explanatory view of an aspect of attaching a floor surface sheet.

With reference to FIG. 2, an aspect of attaching the floor surface sheet 20*a* to an outline frame 11*c* for the floor surface will be described. As illustrated in B1, the floor surface sheet 20*a* is provided with a sleeve 25, and first, the user U passes the outline frame 11*c* through the sleeve 25 so as to roughly position the floor surface sheet 20*a* in an X-direction and a Y-direction.

Next, the user U holds an end of the floor surface sheet 20*a* by his/her hand H, and folds the floor surface sheet 20*a* toward its under surface side along the outline frame 11*c* while applying tension to the floor surface sheet 20*a* by pulling it toward himself/herself as indicated by an arrow t. Then, as illustrated in B2, the user U couples hook and loop fasteners 26 (Velcro (Registered Trademark), MAGICTAPE (Registered Trademark), or the like) provided on an under surface of the floor surface sheet 20*a* to fix the floor surface sheet 20*a* to the outline frame 11*c*.

In this case, since the floor surface sheet 20*a* is stretched over the outline frame 11*c* in different stretching ways in the X-direction and the Y-direction, the tension of the floor surface F formed by the floor surface sheet 20*a* illustrated in B2 is strengthened. Therefore, the stiffness of the assembly-type frame structure 1 can be maintained high.

3. Procedure of Dismantling Frame Structure

Figure 3:
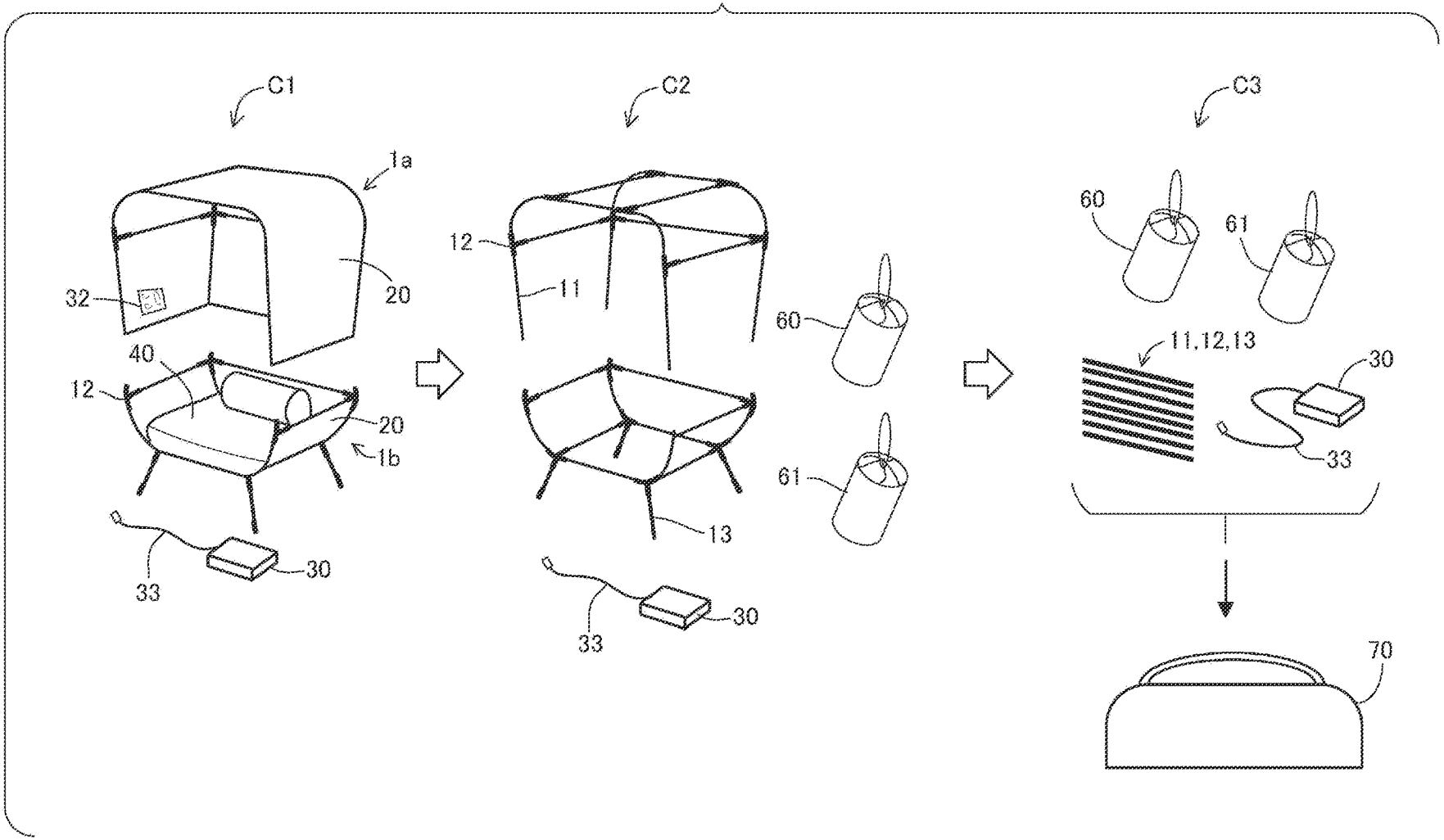
FIG. 3 is an explanatory view of a procedure of dismantling the frame structure.

With reference to FIG. 3, a procedure in dismantling the frame structure 1 upon finishing the use of the frame structure 1 will be described. As illustrated in C1, first, the user U disconnects the battery cable 33 from the outlet 32 and removes the battery 30 from the battery attachment portions 31*a*, 31*b* (see FIG. 1). Then, the user U disconnects an upper portion 1*a* from the joint 12 that connects the upper portion 1*a* and a lower portion 1*b* of the frame structure 1 to separate the upper portion 1*a* and the lower portion 1*b*.

Next, as illustrated in C2, the user U disconnects the sheet 20 from the outline frame 11 and houses the folded sheet 20 in a housing bag 60. Further, the user U takes out the air cushion 40 and releases the air therefrom and houses the folded air cushion 40 in a housing bag 61.

Next, as illustrated in C3, the user U disconnects the outline frame 11 and the support frame 13 from the joint 12 and puts them together in a single unit form. Then, the user U puts together and houses, in one housing bag 70, the housing bag 60 that houses the sheet 20, the housing bag 61 that houses the air cushion 40, the outline frame 11, the joint 12, and the support frame 13 that are put together as a single unit form, the battery 30, and the battery cable 33.

In this manner, the user U can easily disassemble and dismantle the frame structure 1. Then, the user U easily carries one housing bag 70 and assembles the frame structure in a favorite place so that a personal space can be secured.

4. Another Embodiment

In the aforementioned embodiment, the weight load of the user U exerted on the floor surface F with the floor surface sheet 20*a* is dispersed by including the air cushion 40, but when the weight load resistance of the floor surface F with the floor surface sheet 20*a* is sufficient, the air cushion 40 may be omitted.

In the aforementioned embodiment, the battery attachment portions 31*a*, 31*b* for attaching the battery 30 to the outline frame 11 are illustrated, but the configuration may be made such that the battery 30 is attached to the under surface of the floor surface sheet 20*a*. In this case, for example, a battery attachment portion in a pocket shape that houses the battery 30 may be provided on the under surface of the floor surface sheet 20*a*.

In the aforementioned embodiment, the external battery connecting portion 34 for connecting the battery 30 to the external battery 30' is provided, but the configuration may be made so as to omit the external battery connecting portion 34.

Note that FIG. 1 is a schematic view illustrating the functional configuration of the frame structure 1 segmented in accordance with the major processing contents for facilitating understanding of the invention of the present disclosure, and the functional configuration of the frame structure 1 may be based on other segments.

5. Configurations Supported by the Aforementioned Embodiments

The aforementioned embodiments are specific examples of the following configurations.

(Configuration 1) A frame structure defining a space capable of accommodating a user, the frame structure including a plurality of outline frames that forms an assembly-type framework for the space, a sheet that is stretched over the framework so as to form a floor surface, a side surface, and a top surface of the space, a support frame that supports the floor surface at a position higher than a base surface where the frame structure is placed, a battery attachment portion that enables attachment of a battery to an under surface side of the floor surface, an outlet provided on any of the floor surface, the side surface, and the top surface, and a battery connecting portion that connects the battery attached to the battery attachment portion and the outlet.

According to the frame structure of Configuration 1, the frame structure can be provided that defines a personal space where a home electric appliance is easily used and that is easy to carry. Further, with a battery housing portion provided on the under surface side of the floor surface, the frame structure being blown away by wind can be restricted by the weight of the battery housed in the battery housing portion.

(Configuration 2) The frame structure according to Configuration 1, including an air cushion that is provided on an upper surface of the floor surface and inflated by air injection, the air cushion having an outer periphery when inflated larger than an outer periphery of a framework of the floor surface.

According to the frame structure of Configuration 2, when a user sits on the floor surface thereby exerting the weight load on the floor surface, the weight load is dispersed via the air cushion to thus restrict sinking of the floor surface. In this manner, a load exerted on the battery due to contact of the battery housing portion with the base surface can be prevented.

(Configuration 3) The frame structure according to Configuration 1 or Configuration 2, in which the battery attachment portion is attached to the outline frame.

According to the frame structure of Configuration 3, the battery housing portion is attached to the outline frame instead of a sheet portion of the floor surface, so that the stiffness of the battery attachment portion can be surely secured.

(Configuration 4) The frame structure according to either one of Configuration 1 and Configuration 3, including an external battery connecting portion for connecting the battery connecting portion and an external battery other than the battery.

According to the frame structure of Configuration 4, when there is a surplus of a residual amount of the battery attached to the battery attachment portion, the power is supplied to the external battery with a low residual power, so that use of an electric appliance connected to the external battery can be continued.

REFERENCE SIGNS LIST

1 frame structure
10 framework
11 outline frame
12 joint
13 support frame
20 sheet
20*a* floor surface sheet
26 hook and loop fastener
30 battery
31 battery attachment portion
32 outlet
33 battery cable
34 external battery connecting portion
35 external connection cable
40 air cushion
60 housing bag for sheet
61 housing bag for air cushion
70 housing bag
U user
F floor surface
G base surface

What is claimed is:

1. A frame structure defining a space capable of accommodating a user, the frame structure comprising:

a plurality of outline frames that form an assembly-type framework for the space;

a sheet that is stretched over the framework so as to form a floor surface, a side surface, and a top surface of the space;

a support frame that supports the floor surface at a position higher than a base surface where the frame structure is placed;

a battery attachment portion that enables attachment of a battery to an under surface side of the floor surface;

an outlet provided on any of the floor surface, the side surface, and the top surface; and a battery connecting portion that connects the battery attached to the battery attachment portion and the outlet.

2. The frame structure according to claim 1, comprising an air cushion that is provided on an upper surface of the floor surface and inflated by air injection, the air cushion having an outer periphery when inflated larger than an outer periphery of a framework of the floor surface.

3. The frame structure according to claim 1, wherein the battery attachment portion is attached to at least one of the outline frames.

4. The frame structure according to claim 3, comprising an external battery connecting portion for connecting the battery connecting portion and an external battery other than the battery.

* * * * *